US007270145B2

(12) United States Patent
Koezler

(10) Patent No.: US 7,270,145 B2
(45) Date of Patent: Sep. 18, 2007

(54) UNLOADING/VENTING VALVE HAVING INTEGRATED THEREWITH A HIGH-PRESSURE PROTECTION VALVE

(75) Inventor: Robert L. Koezler, Kearney, MO (US)

(73) Assignee: Haldex Brake Corporation, Kansas City, MO (US)

( * ) Notice: Subject to any disclaimer, the term of this patent is extended or adjusted under 35 U.S.C. 154(b) by 765 days.

(21) Appl. No.: 10/231,771

(22) Filed: Aug. 30, 2002

(65) Prior Publication Data

US 2004/0040601 A1 Mar. 4, 2004

(51) Int. Cl.
*F04B 49/035* (2006.01)

(52) U.S. Cl. ..... 137/522; 137/565.33; 417/282; 417/440

(58) Field of Classification Search ..... 137/115.23, 137/522, 565.35; 417/278, 311, 282, 440
See application file for complete search history.

(56) References Cited

U.S. PATENT DOCUMENTS 1,689,673 A * 10/1928 Lalor ..... 417/311
2,700,397 A * 1/1955 Compton ..... 137/565.35
3,343,217 A * 9/1967 Daubenberger ..... 417/311
3,578,883 A 5/1971 Cheney
3,811,792 A * 5/1974 Kennedy, Jr. ..... 417/311
3,862,782 A 1/1975 Horowitz et al.
3,866,623 A 2/1975 Klimek
4,407,548 A 10/1983 Graham
4,907,842 A 3/1990 Goldfein
5,615,929 A 4/1997 Broome
6,170,508 B1 * 1/2001 Faust et al. ..... 137/115.23
6,280,159 B1 * 8/2001 Agner et al. ..... 417/440

* cited by examiner

*Primary Examiner*—John Rivell
(74) *Attorney, Agent, or Firm*—St. Onge Steward Johnston & Reens LLC

(57) ABSTRACT

The invention relates to valves for air compressors, and more particularly, to an unloading/venting valve having integrated therewith a high-pressure protection valve where a pressure reducing valve has a discharge port in communication with the air system and a vent. The valve utilizes a valve body biased to form a seal between the discharge port and the vent. A governor monitors the air pressure in the system and generates a signal to move the valve body against the bias and unloads the system when a first predetermined threshold pressure is reached. In the event of a failure of the valve body to move at the first threshold pressure, the valve body is movable against the bias in response to a second predetermined threshold pressure reached in the system, thereby unloading the system.

20 Claims, 4 Drawing Sheets

UNLOADING/VENTING VALVE HAVING INTEGRATED THEREWITH A HIGH-PRESSURE PROTECTION VALVE

FIELD OF THE INVENTION

The invention relates to valves for air compressors, and more particularly, to an unloading/venting valve having integrated therewith a high-pressure protection valve.

BACKGROUND OF THE INVENTION

The air compressor on heavy-duty trucks and off-road equipment is constantly in operation. To shut the compressor down, i.e. to stop generating air, the compressor is designed to vent the discharge of the compressor to the atmosphere. Typically a governor that regulates the air pressure in the system will send a signal to open a valve, resulting in a venting of the system and a release of air pressure.

The invention of the integrated compressor high-pressure protection valve is the result of a need to protect the compressor, and other system components, from unintentional high pressure in the air system in the case of a failure in the venting process in normal operation.

Through unforeseen failures, the compressor may stay in the loaded, or on-cycle, condition, and keep building up the air pressure in the air brake system to the point of failure of some components. There are documented failures within the industry where the air compressor had failed to shut down, causing several hundreds to thousands of dollars of repairs and lost time. Commonly, high pressure relief valves are located down-stream in the air system and not in the head of the compressor. While generally providing emergency relief for the entire system, these down stream high-pressure relief valves are more effective in protecting the components in the system which are proximate to the relief valves. However, failures often occur in the winter months, where moisture can collect and freeze, which isolates down-stream high-pressure relief valves from the air compressor. In this case, if a high-pressure situation is encountered, the relief valve may not relieve the pressure at the air compressor, and the air compressor may be damaged.

It is well known to utilize valves of different designs in air compressor systems to individually perform either an unloading/venting function or a high pressure relief function. Current compressors, however, used in the heavy trucking industry do not incorporate high pressure relief with unloading of the compressor. Typically, a separate high pressure relief valve is required in the air system, and is installed at various locations within that system. Usually, these are not available to protect the compressor, but to protect those devices that are near to them.

Similarly, current compressors that do have a high pressure relief valve incorporated into the head of an air compressor have been single function only. These compressors do not couple this feature to a valve device that will also unload the compressor. While it is known to incorporate numerous sub-valves within complex multifunction units, these valves do not enjoy the benefits of ease and efficiency in manufacturing, installation and maintenance derived from the single valve performing two necessary functions that can be conveniently assembled in the head of air compressor disclosed herein An explanation of the use of high pressure relief valves in air brake systems is found in U.S. Pat. No. 3,862,782 to Horowitz et al. Horowitz discloses a control valve for use in a vehicle air brake system to apply brake releasing pressure to spring-actuated brakes. The valve includes a protection valve for the vehicle service tank, as well as a check valve for protecting the vehicle emergency tank. In addition, the valve includes a piston and a shuttle for controlling the passage between the vehicle emergency tank and the spring brake chambers and a check valve for bleeding trapped pressure from the service line.

Also of interest to this disclosure is U.S. Pat. No. 4,907,842 to Goldfein. Goldfein discloses an air brake system with a multifunction control valve; a multifunction control valve for an air brake system; various sub-valves within the multifunction control valve—including a pressure protection valve, a pressure reducing valve, an emergency control valve, and a syncro valve. In one embodiment all four types of sub-valves are within a single unitary housing of the multifunction valve.

The Goldfein patent discloses a pressure reducing valve system for use with a separate compressor for reducing the pressure within an air brake system. However, the Goldfein patent does not disclose a system that further acts as a safety release valve as described in the present invention. Rather, even where the sub-valves are within a single unitary housing of the multifunction valve, Goldfein relies upon a separate pressure protection valve that is unassociated with the pressure reducing valve. Furthermore, the Goldfein patent does not appear to disclose integrating either of these valves into the compressor. Neither the protection relief valve combination nor the integration of such with the compressor is disclosed in Goldfein.

Such a complex setup as disclosed in Goldfein, having numerous sub-valves housed within a multifunction unit, does not enjoy the benefits of ease and efficiency in manufacturing, installation and maintenance derived from the single valve performing two necessary functions that can be conveniently assembled in the head of air compressor disclosed herein.

What is desired therefore is an unloading/venting valve for an air compressor which incorporates high pressure protection with the ability to unload the compressor, which is assembled in the head of the air compressor, which provides easy assembly because it is installed in one set up of the compressor head in the assembly fixture, which protects the compressor from a failure instead of or in addition to protecting associated components in the air system, and which has a high pressure relief valve cannot fail due to it being isolated from the air system.

SUMMARY OF THE INVENTION

Accordingly, it is an object of the invention to provide an unloading/venting valve for an air compressor which incorporates high pressure protection with the ability to unload the compressor.

It is a further object of the invention to provide an unloading/venting valve for an air compressor which is assembled in the head of the air compressor.

It is a further object of the invention to provide an unloading/venting valve for an air compressor with easy assembly because it is installed in one set up of the compressor head in the assembly fixture.

It is a further object of the invention to provide an unloading/venting valve for an air compressor that protects the compressor from a failure instead of or in addition to protecting associated components in the air system.

It is also desired to provide a high-pressure protection relief valve for an air compressor where the high pressure relief valve cannot fail due to it being isolated from the air system.

These and other objects of the invention are achieved in an embodiment by provision of an air system with a pressure reducing valve having a discharge port in communication with the air system and a vent comprising a valve body which is biased to form a seal between the discharge port and the vent. A governor monitors the air pressure in the system and generates a signal when a first threshold pressure within the system is reached. The valve body is movable against the bias in response to the signal generated by the governor, such that the discharge port is in communication with the vent thereby allowing air to escape from the system. In the case of a governor failure when the valve body is not moved when the first threshold pressure within the system is reached, the valve body may be movable against the bias in response to a second threshold pressure, greater than the first threshold pressure, within the system being reached such that the discharge port is in communication with the vent thereby allowing air to escape from the system.

It is also preferable that the invention may provide an air system with a pressure reducing valve wherein the vent is in communication with an input of the air compressor thereby allowing the pressurized air to recycle through the system. The pressure reducing valve may be fitted with a vented cap to maintain atmospheric pressure behind the valve body and the pressure reducing valve may be assembled and installed in one step in a head part of a compressor.

It is also preferable that the invention may provide an air system with a pressure reducing valve wherein, the valve body is a piston and wherein the valve is a shuttle valve comprising a shuttle piston which is biased to form a seal between the discharge part and the vent. The shuttle piston may be movable against the bias when the force exerted on the shuttle body resulting from the air pressure in the system and the force resulting from the governor signal exceed the force that causes the seal between the discharge port and the vent.

It is also preferable that the invention may provide an air system with a pressure reducing valve wherein, the governor signal may be an air pressure signal that is sent to a governor cavity. The governor cavity may be formed in the space defined between the shuttle piston and the shuttle valve housing, wherein, the shuttle piston is movable against the bias when the force exerted on the shuttle piston resulting from the air pressure in the system and the force resulting from the governor air pressure signal exceed the force that causes the seal between the discharge port and the vent.

In another embodiment the objects of the invention are achieved by provision of a pressure reducing valve system comprising a shuttle valve having a shuttle piston biased to form a seal between the discharge port and the vent. A governor monitors the air pressure of the system and generates a signal when a first threshold pressure within the system is reached and wherein, the shuttle piston is movable against the bias in response to the signal generated by the governor, such that the discharge port is in communication with the vent thereby allowing air to escape from the system. In the case of a governor failure when the shuttle piston is not moved when the first threshold pressure within the system is reached, the shuttle piston may be movable against the bias in response to a second threshold pressure, greater than the first threshold pressure, within the system being reached such that the discharge port is in communication with the vent thereby allowing air to escape from the system.

It may be preferable that the invention may provide an air system with a pressure reducing valve wherein, the governor signal comprises an air pressure signal sent to a governor cavity which may be formed in the space defined between the shuttle piston and the shuttle valve housing.

It may also be preferable that the invention may provide an air system with a pressure reducing valve wherein, the shuttle piston is movable against the bias when the force exerted on the shuttle piston resulting from the air pressure in the system and the force resulting from the governor air pressure signal exceed the force that causes the seal between the discharge port and the vent. The vent may be in communication with an input of the air compressor thereby allowing the pressurized air to recycle through the system. The shuttle valve may be fitted with a vented cap to maintain atmospheric pressure behind the shuttle piston and the pressure reducing valve may be assembled and installed in one step in a head part of a compressor.

BRIEF DESCRIPTION OF THE DRAWINGS

The present invention may be more clearly understood from the following description of a specific and preferred embodiment read in conjunction with the accompanying detailed drawings; wherein.

DETAILED DESCRIPTION OF PREFERRED EMBODIMENTS

The invention relates to valves for air compressors, and more particularly, to an unloading/venting valve having integrated therewith a high-pressure protection valve. The unloading/venting valve may be of any type known in the art, such as a shuttle valve, ball valve, piston valve, check valve, etc. Likewise, the valve body may be of any type known in the art corresponding to the unloading/venting valve chosen. In the embodiment illustrated in FIGS. 1-5, a shuttle valve 10 is utilized having a shuttle piston 30 as the valve body that actuates within the shuttle valve 10.

Figure 1:
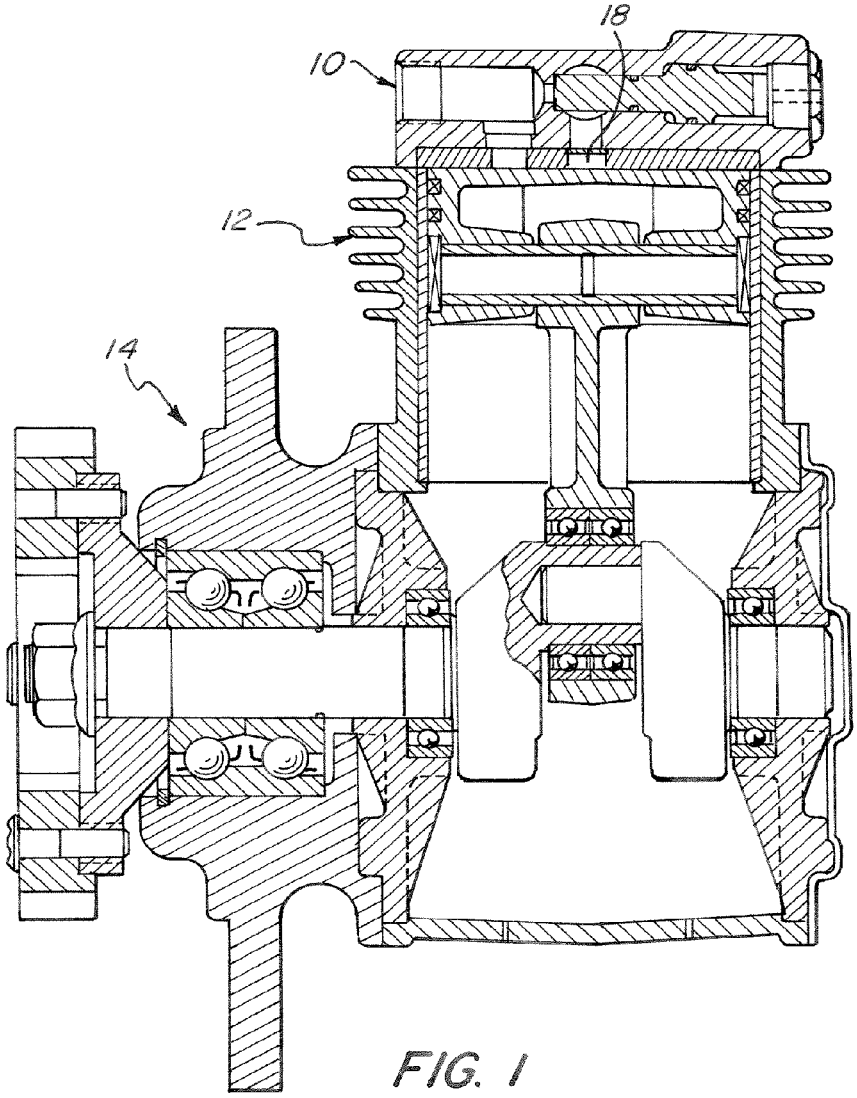
FIG. 1 is a cross-sectional side view of an unloading/venting valve having integrated therewith a high-pressure protection valve and a typical compressor in accordance with the invention.
Figure 2:
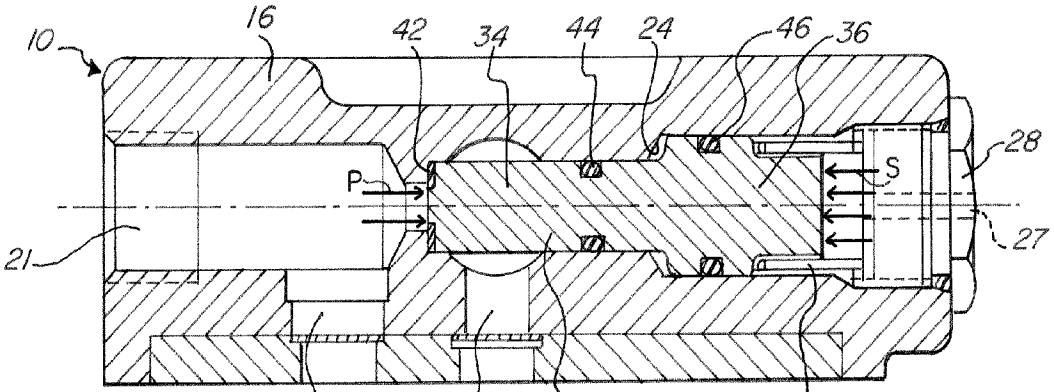
FIG. 2 is an enlarged cross-sectional side view of the unloading/venting valve having integrated therewith a high-pressure protection valve shown in FIG. 1 in the closed position.
Figure 3:
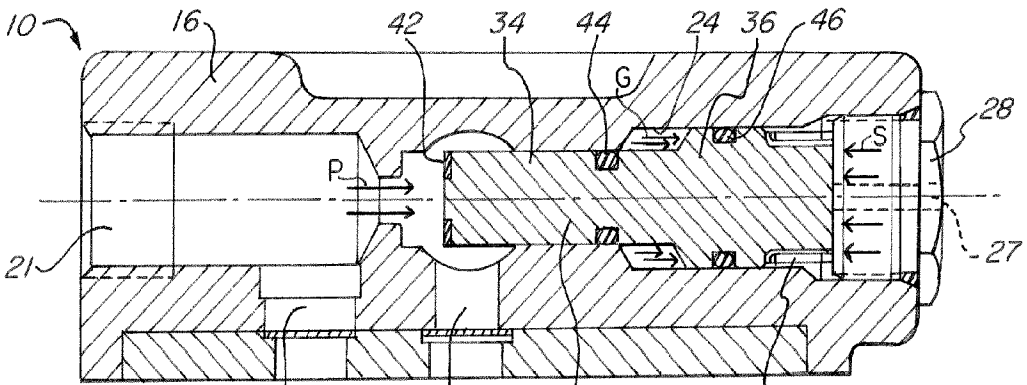
FIG. 3 is an enlarged cross-sectional side view of the unloading/venting valve having integrated therewith a high-pressure protection valve shown in FIG. 1 in the opened position.

Referring to FIG. 1, where like numbers refer to like elements in the drawings, a shuttle valve 10 is shown situated in the head of the compressor 12. The compressor is shown generally as 14. FIGS. 2 and 3 provide greater detail of the shuttle valve 10. The shuttle valve 10, communicates with a vent 20 and a discharge port 22. The discharge port 22 communicates with the rest of the air system (not shown) through the system discharge 21 and with the air compressor 14. The vent 20 may communicate directly to atmosphere, into an inlet port 18 of the head of the air compressor 12 or any other known means to unload an air compressor.

The shuttle piston 30 has a seal 42 on one end that will form the seal between the compressor's discharge air passage 22 and vent 20. In the illustrated embodiment, a spring 38 is situated on the other end of the shuttle piston 30 to bias the piston to close the discharge passage 22 from the vent 20. The bias on the valve body may be effected by springs, or by pistons or by other means known in the art. The spring 38 utilized in the illustrated embodiment is designed to provide a spring force (S) on the shuttle piston 30. A cap 28 fitted with an aperture 27 allows the spring chamber 26 to maintain atmospheric pressure.

The air compressor supplies an air brake system with pressurized air through the system discharge 21 while the system air pressure remains below a first predetermined threshold pressure. A governor 50 monitors the air pressure in the system. (See FIGS. 4 and 5) While the compressor 14 is running below this first predetermined threshold pressure, the unloading/venting valve is closed so that there is no air communication between a discharge passage 22 and a vent 20. In the enlarged cross-sectional view of the shuttle valve in FIG. 2, the shuttle piston 30 is shown in the closed position.

When a predetermined first threshold air pressure is reached in the system, the governor 50, provides a signal to the shuttle valve which causes the piston to shuttle and the valve to open (FIG. 3). The governor signal may be electrical or servomechanical or by any means known in the art. The governor signal may be capable of mechanically causing the valve to open allowing the system to unload/vent. However, it may be preferred that the signal comprises pressurized air, as is the case with the embodiment shown in FIGS. 1-5.

The governor cavity 24 is formed in the space defined between the shuttle valve housing 16 and the shuttle piston 30. The shuttle piston 30 has a smaller diameter portion 34 and a larger diameter portion 36. The shuttle valve housing 16 is shaped to accommodate the smaller diameter portion 34 and a larger diameter portion 36 of the shuttle piston 30 forming the governor cavity 24. The o-ring 44 on the smaller diameter portion 34 and the o-ring 46 on the larger diameter portion 36 seal the governor cavity 24 to allow the shuttle piston 30 to overcome the bias to movement when an air pressure signal is provided from the governor to un-load the compressor 14.

The system air pressure results in an air pressure force (P) acting upon the seal between the shuttle piston and the discharge port. The air pressure of the system provides an air pressure force (P) against the shuttle piston 30 adjacent the piston seal 42 which is opposite to the spring force (S). When the governor signal reaches the governor cavity 24, a governor force (G) is also applied to the piston 30 in a direction opposite to the spring force (S). The governor force (G) is shown in greater detail in FIG. 4. When the combination of air pressure force (P) and governor force (G) are less than spring force (S), the shuttle piston is biased closed, as illustrated in FIG. 2.

Figure 4:
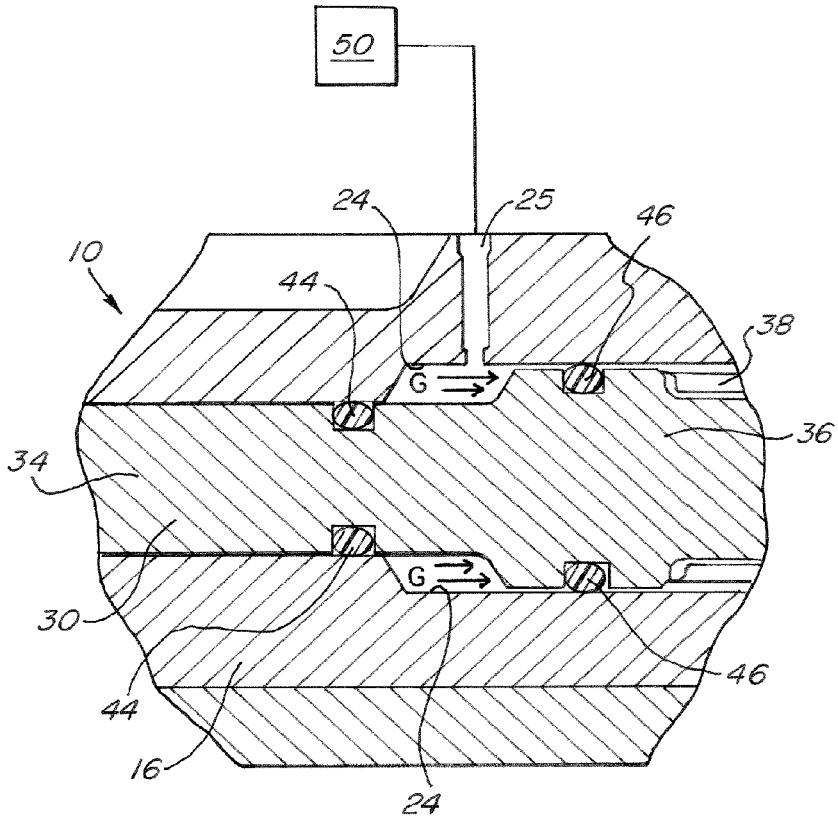
FIG. 4 is an enlarged cross-sectional side view of the governor port and governor cavity of the unloading/venting valve having integrated therewith a high-pressure protection valve shown in FIG. 1.
Figure 5:
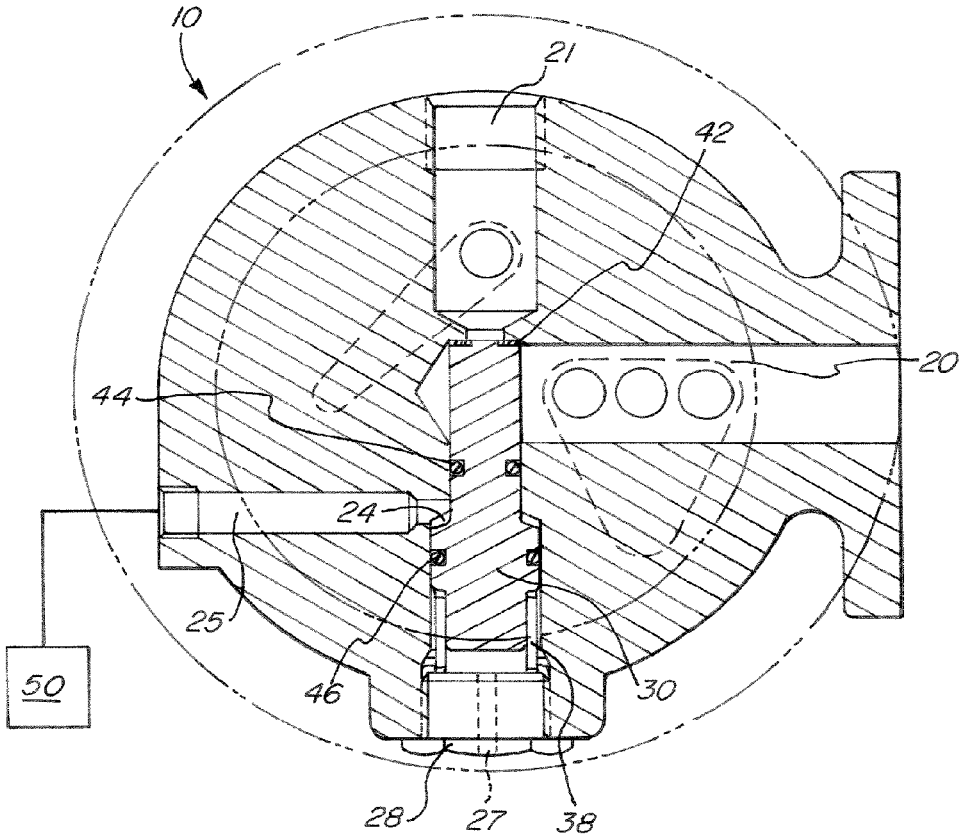
FIG. 5 is a cross-sectional top view of the unloading/venting valve having integrated therewith a high-pressure protection valve shown in FIG. 1.

FIGS. 4 and 5 illustrate how the governor 50 communicates a pressurized air signal when the first threshold air pressure is reached in the air system to the governor cavity 24 through the governor port 25 resulting in governor force (G) acting on the shuttle piston 30 and against the spring force (S). Also when the first threshold air pressure is reached, an air pressure force (P1) acts on the piston 30 against the spring force (S). With both the governor signal force (G) and the system air pressure force (P) contributing to the opening of the valve, now P1+G>S and the piston 30 shuttles, opening the valve 10 and thereby opening the passage between the discharge port 22 and the vent 20. FIG. 3 shows the shuttle piston 30 in the open position. The discharge air then escapes through the vent 20 to atmosphere, or as shown in FIG. 1, through an input port 18 into the head of the compressor 12.

After the system air pressure has sufficiently decreased, the governor 50 releases its signal to the shuttle valve 10. The shuttle piston 30 again is biased the opposite direction by the spring force (S) closing the passage between the discharge port 22 and the vent 20. The discharge air again flows from the discharge passage 22 through the system discharge 21 to the air system components.

Due to certain potential failures, the system air pressure may exceed the first threshold pressure and a governor force (G) may not be generated by the governor signal. The valve 10 will remain closed as the system air pressure continues to increase, putting the system components in danger of overloading.

However, as the system air pressure increases, the air pressure force (P) consequently also increases. A second air pressure force (P2) acting on the piston when the second threshold pressure is reached will be greater that the spring force (S). At this time, the bias on the piston 30 will be overcome and the piston will shuttle to the open position as illustrated in FIG. 3, thus relieving the discharge air and preventing over-pressurization of the system.

When the combined force from the governor signal pressure (G) acting on the shuttle piston 30 within the governor cavity 24 and the force from the system air pressure (P) acting on the shuttle piston 30 where it forms the seal with the discharge port 22 and the vent 20 is greater than the spring bias force (S), the valve will open. This is illustrated by the equation G+P>S.

As an example, the first threshold air pressure setting may be 180 psi for units sold in North America and 250 psi for units sold elsewhere. At the first threshold air pressure, a force (P1) is acting on the piston where it forms the seal with the discharge port and the vent. When the first threshold air pressure is reached, the governor sends a pressurized air signal through the governor port into the governor cavity. The combined force from the governor signal pressure (G) acting on the governor cavity and the force from the first threshold air pressure (P1) acting on the piston where it forms the seal with the discharge port and the vent is greater than the spring bias force (S). Under normal operation, the valve will open, when G+P1>S.

After receiving the signal from the governor, the piston shuttles, which opens communication between the discharge and the vent. The discharge air is then allowed to vent. In the illustrated embodiment, the air is discharged through the inlet passage into the head of the compressor.

As the air pressure of the system is reduced, the force (P) against the piston seal decreases to less than P1. Also, when a set amount of air pressure decrease is achieved, the governor then releases its signal to the governor cavity, reducing the governor signal force (G). The combined force is no longer sufficient to overcome the spring bias force (S). This is illustrated by G+P<S. At this point, the shuttle piston again is biased in the opposite direction and the passage between the discharge and the vent is closed. The pressurized air from the compressor again moves from the discharge port through the system discharge to the air system components. Under normal operation, this cycle will continue as necessary.

If the valve does not open at the first threshold pressure due to an unforeseen system failure, the air pressure in the system will continue to increase. Such system failures may include a failure in the governor sensor, the governor failing to receive or send the signal or a failure in the seals forming the governor cavity. The unload/venting valve then also performs a high pressure relief function.

At a second threshold pressure, the force (P2) exerted against the piston at the seal with the discharge port and the vent will exceed the spring bias force (S). The piston will shuttle, opening the valve to prevent over-pressurization of the system and in particular, to provide the air compressor with emergency unloading/venting. This is illustrated by P2>S.

Depending on the extent of the system failure, the governor signal force (G) may be greater than zero. Therefore, there may be sufficient pressure in the governor cavity to shuttle the piston prior to the second threshold pressure. The necessary conditions for the system to unload/vent are still met, such that G+P>S.

Although the invention, a high-pressure protection shuttle valve for an air compressor which incorporates high pressure protection with the ability to vent/unload the compressor, has been described with reference to a particular arrangement of parts, features and the like, these are not intended to exhaust all possible arrangements or features, and indeed many other modifications and variations will be ascertainable to those of skill in the art.

What is claimed is:

1. An air system with a pressure reducing valve having a discharge port in communication with the air system and a vent comprising:

a valve body, said valve body biased to form a seal between the discharge port and the vent;

a governor for monitoring the air pressure in the system, said governor generating a signal when a first threshold pressure within the system is reached;

wherein, said valve body is movable against the bias in response to the signal generated by said governor, such that the discharge port is in communication with the vent thereby allowing air to escape from the system; and wherein, in the case of a governor failure when said valve body is not moved when the first threshold pressure within the system is reached, said valve body is movable against the bias in response to a second threshold pressure, greater than the first threshold pressure, within the system being reached such that the discharge port is in communication with the vent thereby allowing air to escape from the system.

2. The system defined in claim 1 wherein, said vent is in communication with an input of the air compressor thereby allowing the pressurized air to recycle through the system.

3. The system defined in claim 1 wherein, said pressure reducing valve is fitted with a vented cap to maintain atmospheric pressure behind said valve body.

4. The system defined in claim 1 wherein, said pressure reducing valve is assembled and installed in one step in a head part of a compressor.

5. The system defined in claim 1 wherein, said valve body is a piston.

6. The system defined in claim 1 wherein, said valve is a shuttle valve comprising a shuffle piston, said shuttle piston biased to form a seal between the said discharge port and said vent.

7. The system defined in claim 6 wherein, said shuttle piston is movable against the bias when the force exerted on said shuttle piston resulting from the air pressure in the system and the force resulting from said governor air pressure signal exceed the force that causes the seal between said discharge port and the vent.

8. The system defined in claim 6 wherein, said governor signal comprising an air pressure signal.

9. The system defined in claim 6 wherein, said governor air pressure signal is sent to a governor cavity, said governor cavity formed in the space defined between said shuttle piston and the shuttle valve housing.

10. An air system with a pressure reducing valve having a discharge port in communication with the air system and a vent comprising:

a valve body, said valve body biased to form a seal between the discharge port and the vent;

a governor for monitoring the air pressure in the system, said governor generating a signal when a first threshold pressure within the system is reached;

wherein, said valve body is movable against the bias in response to the signal generated by said governor, such that the discharge port is in communication with the vent thereby allowing air to escape from the system;

wherein, in the case of a governor failure when said valve body is not moved when the first threshold pressure within the system is reached, said valve body is movable against the bias in response to a second threshold pressure, greater than the first threshold pressure, within the system being reached such that the discharge port is in communication with the vent thereby allowing air to escape from the system;

wherein, said vent is in communication with an input of the air compressor thereby allowing the pressurized air to recycle through the system; and wherein, said governor signal comprising an air pressure signal.

11. A pressure reducing valve system comprising:

a shuttle valve;

said shuttle valve consisting of a shuttle piston;

said shuttle piston biased to form a seal between the discharge port and a vent;

a governor to monitor the air pressure of the system, said governor generating a signal when a first threshold pressure within the system is reached;

wherein, said shuttle piston is movable against the bias in response to said signal generated by said governor, such that the discharge port is in communication with the vent thereby allowing air to escape from the system; and wherein, in the case of a governor failure when said shuttle piston is not moved when the first threshold pressure within the system is reached, said shuttle piston is movable against the bias in response to a second threshold pressure, greater than the first threshold pressure, within the system being reached such that the discharge port is in communication with the vent thereby allowing air to escape from the system.

12. The system defined in claim 11 wherein, said governor signal comprising an air pressure signal.

13. The system defined in claim 11 wherein, said governor air pressure signal is sent to a governor cavity, said governor cavity formed in the space defined between said shuttle piston and the shuffle valve housing.

14. The system defined in claim 11 wherein, said shuffle piston is movable against the bias when the force exerted on said shuffle piston resulting from the air pressure in the system and the force resulting from said governor air pressure signal exceed the force that causes the seal between said discharge port and the vent.

15. The system defined in claim 11 wherein, said vent is in communication with an input of the air compressor thereby allowing the pressurized air to recycle through the system.

16. The system defined in claim 11 wherein, said shuffle valve is fitted with a vented cap to maintain atmospheric pressure behind said shuttle piston.

17. The system defined in claim 11 wherein, said pressure reducing valve is assembled and installed in one step in a head part of a compressor.

18. A pressure reducing valve system comprising:

a shuffle valve;

said shuttle valve consisting of a shuttle piston;

said shuttle piston biased to form a seal between the discharge port and a vent;

a governor to monitor the air pressure of the system, said governor generating a signal when a first threshold pressure within the system is reached;

wherein, said shuffle piston is movable against the bias in response to said signal generated by said governor, such that the discharge port is in communication with the vent thereby allowing air to escape from the system;

wherein, in the case of a governor failure when said shuttle piston is not moved when the first threshold pressure within the system is reached, said shuttle piston is movable against the bias in response to a second threshold pressure, greater than the first threshold pressure, within the system being reached such that the discharge port is in communication with the vent thereby allowing air to escape from the system;

wherein, said shuttle piston is movable against the bias when the force exerted on said shuttle body resulting from the air pressure in the system and the force resulting from the governor signal exceed the force that causes the seal between said discharge port and the vent;

wherein, said vent is in communication with an input of the air compressor thereby allowing the pressurized air to recycle through the system;

wherein, said governor signal comprising an air pressure signal;

wherein, said governor air pressure signal is sent to a governor cavity, said governor cavity formed in the space defined between said shuttle piston and the shuttle valve housing; and wherein, said shuttle piston is movable against the bias when the force exerted on said shuttle piston resulting from the air pressure in the system and the force resulting from said governor air pressure signal exceed the force that causes the seal between said discharge port and the vent.

19. An air system with a pressure reducing valve having a discharge port in communication with the air system and a vent comprising:

a valve body, said valve body biased to form a seal between the discharge port and the vent;

a governor for monitoring the air pressure in the system, said governor generating a signal when a first threshold pressure within the system is reached;

wherein, said valve body is movable against the bias in response to the signal generated by said governor, such that the discharge port is in communication with the vent thereby allowing air to escape from the system;

wherein, in the case of a governor failure when said valve body is not moved when the first threshold pressure within the system is reached, said valve body is movable against the bias in response to a second threshold pressure, greater than the first threshold pressure, within the system being reached such that the discharge port is in communication with the vent thereby allowing air to escape from the system;

wherein, said pressure reducing valve is assembled and installed in one step in a head part of a compressor and said vent is in communication with a inlet port of said compressor; and wherein, said discharge port and said vent are positioned in the same plane.

20. An air system with a pressure reducing valve having a discharge port in communication with the air system and a vent comprising:

a valve body, said valve body biased to form a seal between the discharge port and the vent;

a governor for monitoring the air pressure in the system, said governor generating a signal when a first threshold pressure within the system is reached;

wherein, said valve body is movable against the bias in response to the signal generated by said governor, such that the discharge port is in communication with the vent thereby allowing air to escape from the system;

wherein, in the case of a governor failure when said valve body is not moved when the first threshold pressure within the system is reached, said valve body is movable against the bias in response to a second threshold pressure, greater than the first threshold pressure, within the system being reached such that the discharge port is in communication with the vent thereby allowing air to escape from the system; and wherein, said valve body has a smaller diameter and a larger diameter forming a governor chamber within the pressure reducing valve and an O-ring on the smaller diameter and an O-ring on the larger diameter portion to seal the governor chamber.

* * * * *

UNITED STATES PATENT AND TRADEMARK OFFICE

CERTIFICATE OF CORRECTION

PATENT NO. : 7,270,145 B2
APPLICATION NO. : 10/231771
DATED : September 18, 2007
INVENTOR(S) : Robert L. Koelzer It is certified that error appears in the above-identified patent and that said Letters Patent is hereby corrected as shown below:

Title Page Should Read

Page 1:

(12) United States Patent

Koelzer

(75) Inventor: Robert L. Koelzer, Kearney, MO (US)

Signed and Sealed this

Nineteenth Day of February, 2008

JON W. DUDAS
*Director of the United States Patent and Trademark Office*